US009182172B2

(12) United States Patent
Jabloñski

(10) Patent No.: US 9,182,172 B2
(45) Date of Patent: Nov. 10, 2015

(54) METHOD FOR OPERATING A CLOTHES DRYING APPLIANCE AND CLOTHES DRYING APPLIANCE

(75) Inventor: Piotr Jabloñski, Lodz (PL)

(73) Assignee: BSH Hausgeräte GmbH, Munich (DE)

( * ) Notice: Subject to any disclaimer, the term of this patent is extended or adjusted under 35 U.S.C. 154(b) by 393 days.

(21) Appl. No.: 13/809,609

(22) PCT Filed: Jul. 4, 2011

(86) PCT No.: PCT/EP2011/061169

§ 371 (c)(1),
(2), (4) Date: Jan. 11, 2013

(87) PCT Pub. No.: WO2012/007299

PCT Pub. Date: Jan. 19, 2012

(65) Prior Publication Data

US 2013/0118024 A1 May 16, 2013

(30) Foreign Application Priority Data

Jul. 13, 2010 (EP) ..... 10169424

(51) Int. Cl.
*D06F 58/28* (2006.01)
*F26B 25/22* (2006.01)

(52) U.S. Cl.
CPC ..... *F26B 25/22* (2013.01); *D06F 58/28* (2013.01); *D06F 2058/2838* (2013.01)

(58) Field of Classification Search
CPC ..... D06F 2058/2835; D06F 2058/2838; D06F 58/28
See application file for complete search history.

(56) References Cited

U.S. PATENT DOCUMENTS

| | | | |
|---|---|---|---|
| 3,818,603 | A | 6/1974 | Marcade |
| 6,067,845 | A | 5/2000 | Meerpohl et al. |
| 2006/0248746 | A1 | 11/2006 | Dittmer et al. |

FOREIGN PATENT DOCUMENTS

| | | | |
|---|---|---|---|
| CN | 1712629 | A | 12/2005 |
| DE | 4411501 | A1 | 10/1994 |
| EA | 201291425 | | 6/2013 |
| WO | WO 2004/059072 | A1 | 7/2004 |

OTHER PUBLICATIONS

International Search Report PCT/EP/2011/061169 completed Dec. 12, 2011.
European Search Report EP 10 16 9424 Dated Jan. 14, 2011.

*Primary Examiner* — David J Laux
(74) *Attorney, Agent, or Firm* — Nixon & Vanderhye, P.C.

(57) ABSTRACT

A method is provided for operating a clothes drying appliance, wherein a moisture content of clothes is determined by measuring a current running through the clothes and wherein the determining takes into account a salt content of the moisture. The clothes drying appliance is adapted to perform the method.

11 Claims, 3 Drawing Sheets

METHOD FOR OPERATING A CLOTHES DRYING APPLIANCE AND CLOTHES DRYING APPLIANCE

This application is a U.S. National Phase of International Patent Application No. PCT/EP2011/061169, filed Jul. 4, 2011, which designates the U.S. and claims priority to European Patent Application No. 10169424, filed Jul. 13, 2010, the entire contents of each of which are hereby incorporated by reference.

BACKGROUND OF THE INVENTION

The invention relates to a method for operating a clothes drying appliance, wherein a moisture content of clothes or laundry is determined by measuring a current running through the clothes. The invention also relates to a clothes drying appliance being adapted to perform the method.

A tumble dryer comprises a rotatable drum to contain clothes. To dry moist clothes, the drum is rotated and heated, e.g. by circulating warm air over the clothes. In many tumble dryers, a desired or target moisture content at the end of a drying process or drying cycle can be selected by a user. To achieve the target moisture content, the tumble dryer monitors the moisture content of the clothes and terminates the drying cycle if the target moisture content has been reached. To monitor the moisture content, some tumble dryers use a current sensor that comprises two electrodes within the drum wherein the electrodes are regularly covered by the clothes. A DC voltage is applied to the electrodes. The value of the resulting current through the clothes is related to the moisture content. The moister the clothes are the greater is the current. The tumble dryer can use this current value to estimate the moisture content and to control the drying cycle accordingly. However, the use of a current sensor has the disadvantage that the electrodes are subject to clothes electrolysis that deteriorates the electrode material and accelerates aging of the electrodes. Further, the current sensor exhibits adverse spatial polarization effects. Also, the computational effort is rather high. And generally there is a desire for a more accurate estimation of the moisture content to achieve better and more consistent drying results.

BRIEF SUMMARY OF THE INVENTION

It is the object of the following invention to provide a possibility to more accurately estimate a moisture content of clothes in a clothes drying appliance (e.g. clothes dryer or combined washing machine and clothes dryer).

The object is achieved according to the features of the independent claims attached. Preferred embodiments can be derived, inter alia, from the dependent claims as well as from the subsequent disclosure. It is also noted that preferred embodiments of the method correspond to preferred embodiments of the clothes drying appliance and vice versa, even if not indicated expressly herein.

The object is achieved by a method for operating a clothes drying appliance, wherein a moisture content of clothes is determined by measuring a current running through the clothes and wherein the determining takes into account a salt content of the moisture. This method makes use of the fact that a salt content improves a conductance and thus a current running through the clothes. Therefore, the salt content can significantly alter a measurement of the current and an estimation of the moisture content. By taking into account the salt content, an error margin of the measurement and the estimation can be greatly reduced.

The salt may in particular be introduced into the clothes by washing them with tap water. The salt may in particular be limestone or another salt. The salt content may then also broadly be expressed in terms of water hardness. The salt content may thus in particular depend on the salt content (e.g. water hardness) of the tap water.

It is a preferred embodiment that the determining comprises determining a gradient of a curve (e.g. a string of pairs of variates and/or a curve fit of the string) representing the moisture content over time and setting at least one target value of a drying cycle based on the gradient. The gradient is a reliable and well defined representative of the salt content. The gradient can be extracted from a curve with a low computational effort.

It is another preferred embodiment that the setting comprises correcting at least one target value of a drying cycle known for a pre-determined salt content by adding a respective offset, wherein the value of the offset is based upon a difference of the determined/measured gradient and a gradient corresponding to the pre-determined salt content. Alternatively, at least one target value of a drying cycle can be (directly) determined based upon the determined gradient.

It is yet another preferred embodiment that the curve is a linear curve. This facilitates determining the gradient and gives a particular robust determination. Also, meeting the target value can be determined rather easily. The linear curve may for example by achieved by using a suitable filter to convert a curve representing the moisture content which has a known or assumed form (e.g. an exponential form) into the linear curve or form.

It is even another preferred embodiment that the curve is an exponential curve. The exponential form is often the 'natural' form of the relation between the moisture content and time, in particular for a constant energy rate. The gradient can be an exponential parameter.

It is also another preferred embodiment that gradients from multiple measurements are stored as an average gradient and wherein the at least one target value is set based on the average gradient. This enhanced a reliability and robustness of the determination of the gradient and, subsequently, the salt content. This embodiment uses the fact that a clothes drying appliance is in practice permanently connected to the same water source and thus is fed by water of basically the same salt content.

It is a further preferred embodiment that the at least one target value comprises a target value representative of the moisture content at which a target time for terminating the drying cycle is reached. This embodiment enables a reliable and well-defined moisture content of the clothes at the end of a drying circle. In other words, a user-selected moisture content of the clothes at the end of a drying circle can be achieved with a high accuracy.

It is also preferred embodiment that a DC voltage signal is applied to the clothes to generate the current through the clothes.

It is an alternative preferred embodiment that an AC voltage signal is applied to the clothes. The use of the AC voltage signal greatly reduces electrolysis of the electrodes by the constant changes of direction of the current running between the electrodes for improved durability or life expectancy. Spatial polarization effects are mostly eliminated. The use of the AC voltage allows for non-complicated computations, as will be explained further below. And also, an accuracy of the estimated moisture content is greatly improved by up to 40% in comparison to contemporarily implemented estimation methods. The current measurement is also a measurement of the clothes' conductance.

In accordance with a preferred embodiment of the invention the AC voltage signal (also called the 'carrier' or 'carrier signal') has a frequency between 200 Hz and 2000 Hz. More preferred, the AC voltage signal has a frequency between 300 Hz and 800 Hz. Still more preferred the AC voltage signal has a frequency of about 400 Hz. On one hand the frequencies or frequency ranges thus specified are high enough to prevent polarization effects and electrolysis to occur at the contact points to the clothes, which could distort the proper measurement and which need to be accounted for in any DC measurement as known from prior art. On the other hand the frequencies or frequency ranges thus specified are low enough to avoid occurrence of effects from AC resistances or reactances like inductive and capacitive resistances that might occur in AC circuits. Presently it is noted that different clothing materials have considerably different dielectric properties which would imply that different capacitive resistances or capacitances would be created from such different materials. Such capacitances are neglectable in measurements at sufficiently low frequencies but would introduce distortions dependent from clothing materials into measurements at higher frequencies.

From considerations related to those set out above, the AC voltage signal may preferredly have a frequency of not more than about 450 Hz to 500 Hz; this upper limit is low enough to neglect a capacitance of the clothes. More preferred the AC voltage signal has a frequency of at least about 350 Hz, more preferably of at least about 400 Hz, even more preferably of about 400 Hz. This frequency or frequency range is high enough to prevent electrolysis. The AC voltage signal may have a frequency of not more than about 450 Hz to 500 Hz; this upper limit is low enough to neglect a capacitance of the clothes.

It is noted that any appropriate choice of the frequency of the AC voltage signal may avoid any harmonics of a line frequency presented by a supply network that delivers power to the appliance. Accordingly, exact choices of frequencies like 350 Hz, 400 Hz, and 450 Hz, for the case of a 50 Hz supply network or frequencies like 360 Hz, 420 Hz, and 480 Hz, for the case of a 60 Hz supply network may not be favored.

It is another preferred embodiment that the AC voltage signal comprises an amplitude of about 5 Volts for easy implementation and ease of use in or with common electronic circuits that often use the same voltage level Vpp=5 V.

It is yet another preferred embodiment that the AC voltage signal is DC filtered (a possible DC portion is eliminated) to enhance accuracy of the measurement.

It is even another preferred embodiment that an envelope signal of consecutive samples is generated from the measured alternating current. The samples may in particular comprise a respective local peak of the measured current within a certain sample time. In other words, the envelope signal may comprise consecutive peak values extracted from the measured alternating current over a corresponding sample time. A local peak may be detected by a peak detector (hardware AM demodulator) or by a peak detection software, or by a demodulation in general terms. A local peak represents the occasion in which, for the sample time, humid clothes best cover the electrodes and give a relatively best approximation of the actual moisture content. This effect in particular occurs for tumble dryers because, in a tumble dryer, the clothes are perpetually tumbled and thus fall onto the electrodes and disengage themselves again from the electrodes after a certain progress of revolution of the drum.

It is yet another preferred embodiment that the envelope signal comprises consecutive peak values extracted from the measured alternating current over a corresponding sample time.

The samples (including the peaks) may preferably be sampled within a predetermined sample time to achieve a well-defined time relation. The sample time may in particular be determined such that the known Nyquist criterion is satisfied. For example, the sample time may be two times or more shorter than the time between clothes hitting the electrodes. In other words, the sample frequency may particularly be two times or more the expected frequency of the laundry or clothes hitting the electrodes. This limits a systematic error margin.

It is yet another preferred embodiment that a maximum value of n consecutive samples is extracted or determined from the envelope signal. n is a positive number, e.g. 64, 128 or 256. This embodiment uses the effect that, in a tumble dryer, because of the perpetual tumbling, the electrodes are sometimes only partly or lightly covered (which results in a low current not representing the true moisture content of the clothes) and sometime well covered (representing the true moisture content of the clothes well). The extraction of the maximum value achieves that only a best approximation of the real moisture content of the clothes from the group of n samples is used for further computation. This enhances accuracy and gives a particularly robust measurement.

It is a further preferred embodiment that a series of maximum values is generated during a drying cycle. By this, an even more accurate computation of the moisture content is possible by using compositions of two or more maximum values. Also, curve fits can be used. The series may in particular come from continuous extraction of maximum values from a consecutive series of n consecutive samples.

It is also a preferred embodiment that the series of the maximum values is passed through a logarithmic filter to give a series of filtered values, wherein in particular the filtered values or a curve derived from the filtered values represent the moisture content over time. The filtered value is a particular useful and accurate representative of a moisture content of the clothes. The logarithmic filter converts a basically logarithmic relation between the moisture content and the time into a linear relationship. The linear relationship or straight line is easier to use for determining the occurrence of a certain incident, e.g. determining when the target moisture content has been reached.

It is a particularly preferred embodiment that the filter uses a relation comprising:

$$y(m)=y(m-1)+\log(a,x(m)-y(m-1)), \text{ wherein} \quad (1)$$

y(m) is an m-th filtered value, y(m−1) is the previous filtered value, a is a parametric log base and x(m) is an m-th maximum value (of n samples) received from the filter. The integer m may be called a series index or series number and preferably has a defined relation to the time t at which the maximum value has been sampled. Relation (1) has been found to give a particularly good compromise between easy computation and good accuracy.

In particular, the target value may be a target filtered value yend at which the time tend to terminate the drying cycle is reached.

In particular, the moisture content G(m) (as a physical quantity) may be derived from y(m) by, e.g., G(m)=f(y(m)) or G(t)=f(y(t)). f(x) is a function that transforms a filtered value y (y(m) or y(t)) into a value of the moisture content G and that may be determined e.g. by experiments. The function f may be stored e.g. by means of a characteristic line and/or in a look-up table.

The object is also achieved by a clothes drying appliance, wherein the clothes drying appliance is adapted to perform the method as described above.

It is a preferred embodiment and also achieves the object as such that the clothes drying appliance comprises at least an AC voltage generator generating an AC voltage, at least one electrode being connected to output ports of the AC voltage generator, the at least one electrode being coverable by the clothes; and a logic functionally connected to the at least one electrode for determining a representative or representative quantity of a moisture content of the clothes from a measured AC current between the electrodes.

It is another preferred embodiment that a DC voltage cut-off means is connected between the AC voltage generator and the at least one electrode. This eliminates a possible DC portion of the carrier signal and enhances an accuracy of the humidity determination.

It is yet another preferred embodiment that a current probe is connected between the at least one electrode and the logic.

It is even another preferred embodiment that a peak detector is connected between the at least one electrode and the logic. The peak detector which may be implemented in hardware or software can determine the maximum values of the AC current measurement samples.

For a precise measurement while using cost-effective electrodes, the electrodes may be inserted or arranged in a bearing-shield of the dryer, in particular a lowest section of the bearing shield. The electrodes may be coated by a non-metallic material, e.g. a plastic.

The electrodes may be molded into the bearing shield, e.g. overmoulded by the bearings shield's plastic material.

BRIEF DESCRIPTION OF THE DRAWINGS

In the following description which in particular refers to the figures of the attached drawings, a preferred embodiment of the invention is schematically described in greater detail. In the drawing.

DETAILED DESCRIPTION OF EXEMPLARY EMBODIMENTS OF THE PRESENT INVENTION

Figure 1:
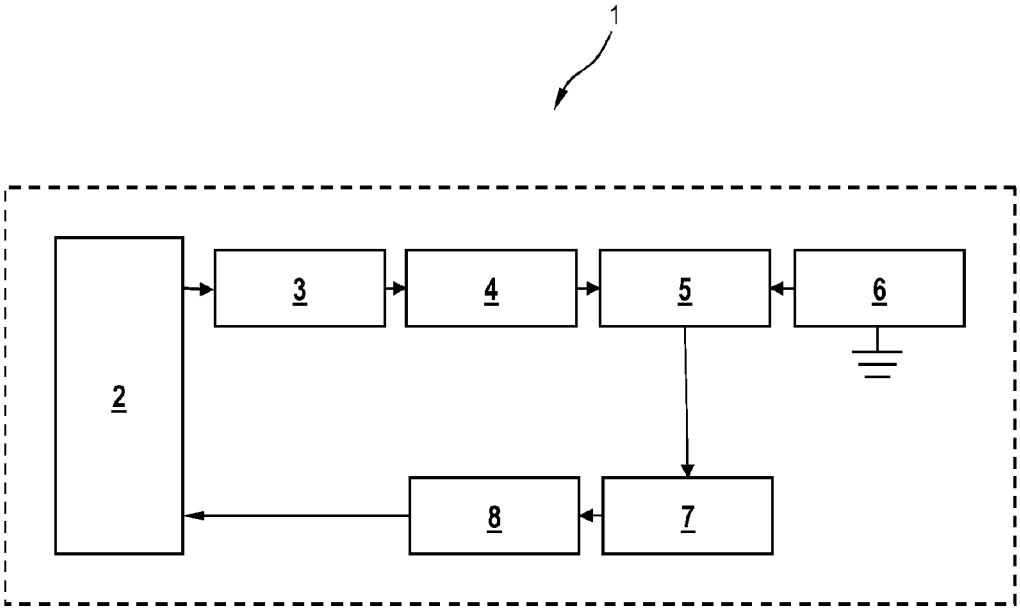
FIG. 1 shows a block diagram of a possible implementation of a moisture content detection of a clothes drying appliance.
Figure 2:
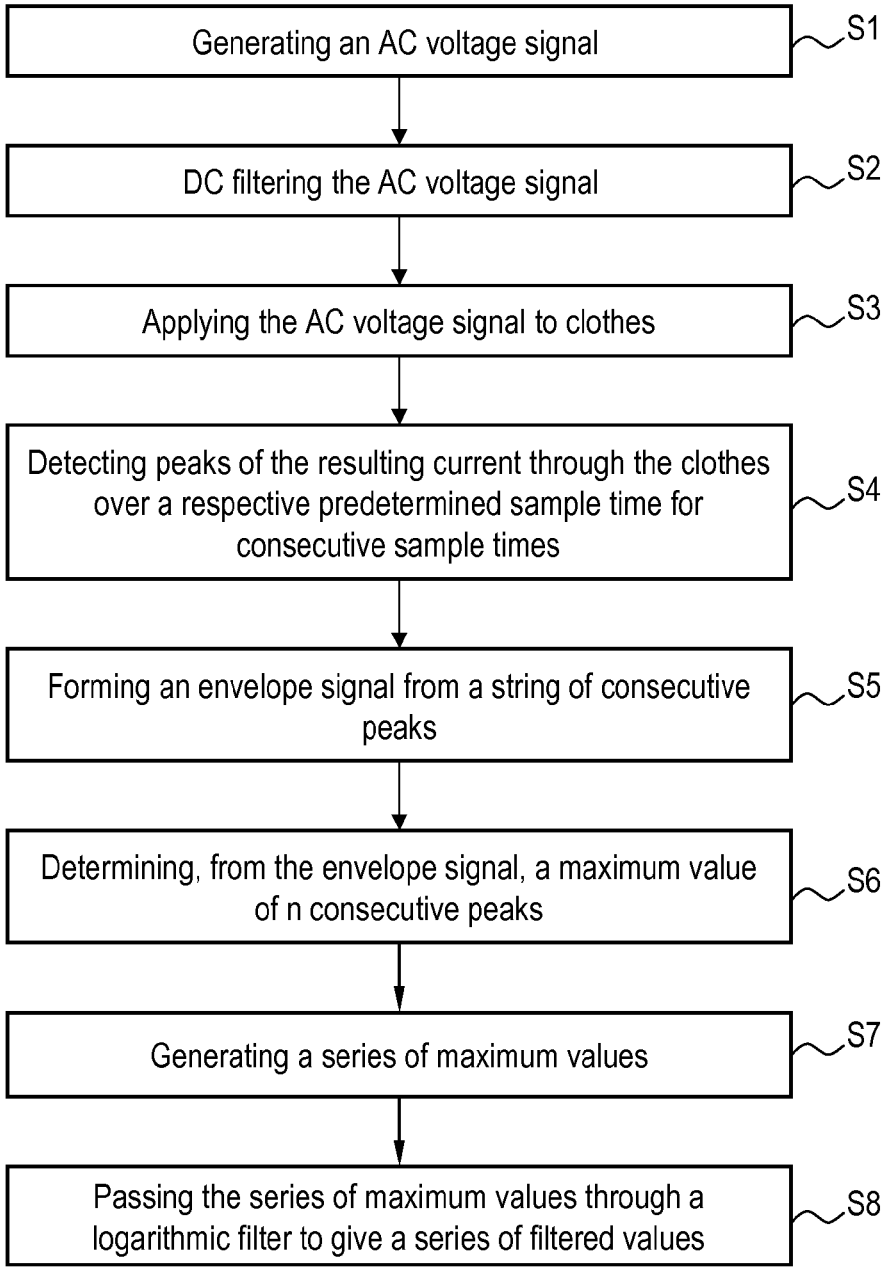
FIG. 2 shows process steps to determine a moisture content of clothes to be dried in a clothes drying appliance.

FIG. 1 sketches a possible implementation of a moisture content detection of a clothes drying appliance represented by a tumble dryer 1. FIG. 2 shows process steps to detect a moisture content of clothes to be dried in a clothes drying appliance. A possible concrete embodiment is now described referring to both figures.

The tumble dryer 1 comprises a logic in form of a controller 2, e.g. a micro-controller, for controlling operation of the tumble dryer 1, in particular a drying cycle. The controller 2 inter alia controls operation of an AC voltage generator 3.

The voltage generator 3 generates an AC voltage signal (step S1) of a frequency of about 400 Hz. This frequency has the advantage that it is high enough to prevent electrolysis but is low enough to neglect a capacitance of clothes 6. The AC voltage is about 5 Volts which corresponds an operation voltage Vpp of the controller 2 and is thus particularly easy to generate.

On its output side the AC voltage generator 3 is coupled to a DC cut-off means 4 (or DC filter). By the DC cut-off means 4 the AC voltage signal from the AC voltage generator 3 is DC filtered (step S2) to remove any DC portion that could deteriorate the accuracy.

The AC voltage signal may, in particular be a square (or quasi-sine) wave which is particularly suitable for creating a temporarily constant voltage level for easier analysis or interpretation. However, also other waveforms may be used.

The output side of the DC cut-off means 4 is coupled to two electrodes 5 that are part of a current probe and that are located on a lower apex of a bearing shield of the tumble dryer 1. Thus, a DC-filtered AC voltage signal is applied to the clothes 6 by the electrodes 5 (step S3). The electrodes 5 are regularly covered by different clothes 6 (laundry) tumbled within a rotatable drum of the tumble dryer 1. If the clothes 6 cover the electrodes 5, a current flows through the clothes 6 between the electrodes 5 thanks to the water (moisture) contained in the clothes 6. The moister the clothes 6 are the higher is the current. In other words, the carrier signal's AC current is heavily modulated by the laundry's conductance: when the laundry has temporarily good contact with the electrodes 5, the current is high. This current is detected or sensed by the current probe.

The two electrodes 5 are functionally coupled to a current-to-voltage (CV) converter 7 for easier computation. The current probe may be omitted, and the electrodes 5 may directly be connected to the CV converter 7. The CV converter 7 is coupled to a peak detector 8. The peak detector 8 may be implemented in hardware (e.g. in a respective integrated circuit) or in software (e.g. within the controller 2).

The peak detector 8 detects a peak of the current (esp. of the absolute value of the current) over a predetermined period of time, the sample time, for consecutive sample times (step S4). The peak or sample represents the occasion in which humid clothes best cover the electrodes over the sample time. They give a relatively best approximation of the real moisture content within the sample time. Thus, the peak detector 8 detects a string or chain of (local, over the sample time) peaks or samples. This string of peaks forms a respective envelope signal (step S5). The envelope signal is a representative of the spatially temporary conductance of the clothes 6.

The envelope is or the samples or peaks are sampled frequently enough to satisfy the known Nyquist criterion. In other words, the sample time is so short that the Nyquist criterion is satisfied. In particular, the sample frequency may be two times or more than the expected frequency of the laundry or clothes 6 hitting the electrodes 5. This limits a sample error margin.

The peak detector 8 is connected to the controller 2 (e.g. via an analog-to-digital converter (ADC) which may be part of the controller 2) which computes the string of samples. It is a first computational step (step S6) to determine, from the envelope signal, a maximum value of n consecutive samples or peaks with n being a positive number. The determination or extraction of the maximum value achieves that only a best approximation of the real moisture content of the clothes from a group of n peaks is used for further computation for enhanced accuracy.

Over the measurement time, a series of maximum values is generated (step S7) that is passed through a logarithmic filter to give a series of filtered values (step S8). The logarithmic filter converts a basically logarithmic relation between the moisture content and the time into a linear relationship. The linear relationship or straight line is easier to use for determining the occurrence of a certain incident, e.g. determining when a predetermined target moisture content has been reached. Generally, other filters may also be used.

In the shown embodiment the filter uses a relation comprising the relation $$y(m)=y(m-1)+\log(a,\ x(m)-y(m-1)),$$

wherein y(m) is an m-th filtered value, y(m−1) is the previous filtered value, a is a parametric log base and x(m) is an m-th maximum value received from the filter. This relation has been found to give a particularly good compromise between easy computation and good accuracy.

The filtered values y(m) (and thus also the string of filtered values y(m)) may be directly used as representative values of the moisture content of the clothes 6 to control a drying cycle of the tumble dryer 1. The filtered values y(m) may also be translated into (physical) values of the moisture content G of the clothes 6, e.g. by using a experimentally of computationally predetermined characteristic curve or relation. For example, the filtered values y(m) may be compared to a target value yend for reaching a target moisture content Gend at the end of a drying cycle, and the drying cycle may be stopped if this target value yend is reached or exceeded.

Figure 3:
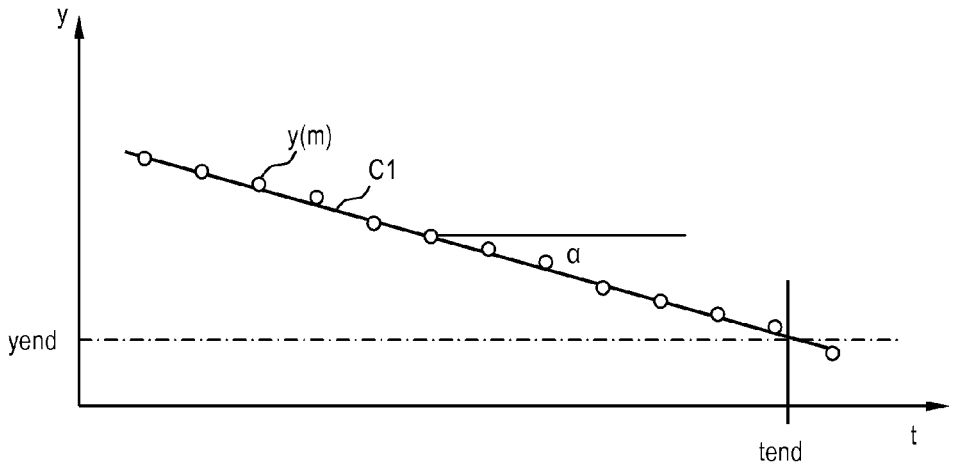
FIG. 3 shows a diagram depicting one possible result from the process of FIG. 2.

FIG. 3 shows a diagram depicting one possible string of filtered values y(m) over time t. By having passed through the logarithmic filter, the values y(m) substantially form a straight line or curve C1 that is pointed downward. Each of the values y(m) corresponds to a value G(m) of the moisture content G or moisture content of the clothes. This correspondence can generally described by the function G(m)=f(y(m)) or G(t)=f(y(t)). If y is equal to the target value yend, the target moisture content Gend has been reached. This may be determined by the fact that one of the filtered values y(m) exceeds (i.e., is smaller than) the target value yend and/or by a filtered value y(m) is within a pre-determined margin around the target value yend.

Figure 4:
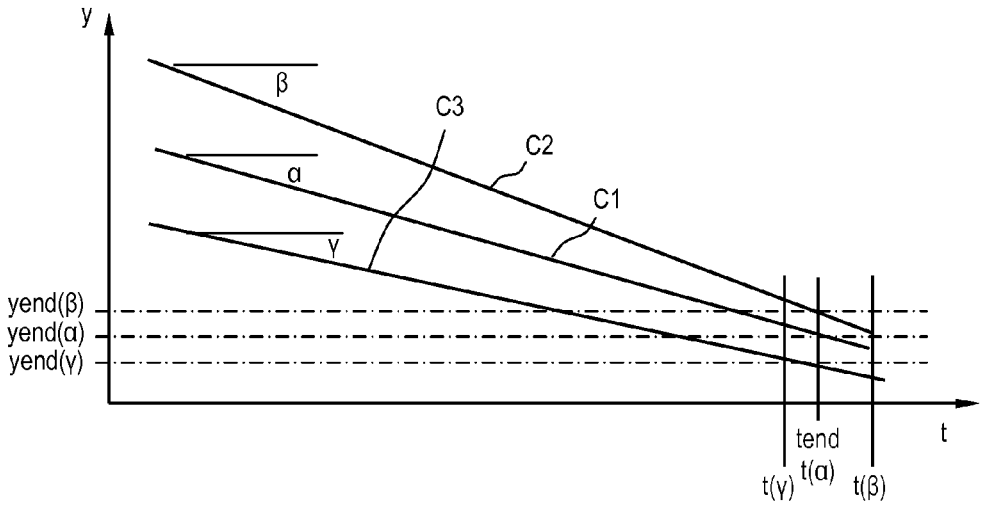
FIG. 4 shows a diagram depicting a relationship between a moisture content and time for a variation of a salt content of the water.

FIG. 4 shows a diagram depicting a relationship between the filtered values y(m or t) and time t or series number m for a variation of a salt content c or salt concentration of the water used for washing the clothes, e.g. tap water. The time t basically correlates to the series number m and can be used in exchange.

Here, the moisture content G (as a physical quantity) can be determined from the filtered values y by the function G=f(y), as described above. The function f may be determined by experiments comparing a moisture content G of the clothes (measured by a different method) with a measured current or quantity derived from it (e.g. the filtered value y). Up to now, the function f is determined without regard for a salt content c.

Curve C1 depicts the linear relationship of the filtered values y and the time t for a medium salt content c, as also shown in FIG. 3. Thus, using water with the medium salt content c gives values of y for which the corresponding moisture content G is known because the function f is correct. However, when the actual salt content c is different from the assumed medium salt content c, the function f introduces an error into determining or knowing the moisture content G. This also holds if the filtered values as such are used to control the drying cycle.

Curve C2 shows a linear relationship of the filtered values y and the time t for a high salt content c. Curve C2 is different from curve C1 in that it is located above curve C1, i.e. that its values y are greater than for the curve C1 for a given point of time. Since the drying process itself (e.g. the energy input) is the same for each curve C1, C2, C3, the real moisture content G at each point of time is also the same. The higher salt content c, however, leads to a higher current and thus to a higher filtered value y and a too high calculated or assumed value of G if using the function f determined for the medium salt content c. Then, a correct target time tend that represents the point of time t to achieve the (real) desired or target moisture content of the clothes would be overstepped. In other words, the assumed target value yend=yend(α) for the medium salt content would be reached some time t(β) after the correct target time tend (=t(α)). This leads to too dry clothes and a waste of energy.

Analogously, curve C3 shows a linear relationship of the filtered values y and the time t for a low salt content c. Curve C3 differs from curve C1 in that it is located below curve C1, i.e. that its values y are smaller than for the curve C1 for a given point of time. This is because a lower salt content c leads to a smaller current, to a smaller filtered value y and thus to a too small calculated or assumed value of G. If a drying process is performed on clothes washed with the low salt content c, the correct target time tend would be achieved too early at a time t(γ). In other words, the assumed target value yend would be reached some time t(γ) before the correct target time tend. This leads to too moist clothes.

To get or assume correct values of the moisture content G (or a related quantity) for a varying salt content c, a gradient g of the curve or relationship between measured current values or values derived from that, e.g. y(m), is considered. This makes use of the fact that the gradient g=g(c) is the steeper the higher the salt content c is. The salt content c can thus be derived by determining the gradient g(c). In other words, the gradient g(c) is used as a measure of the salt content. The gradient g(c) represents the salt content c at a user's premises. For example, the gradient g(c) can be determined for the curves C1 to C3 by g(c)=Δy/Δt. In the present case the gradients g show the following relation: β=g(high salt content) >α=g(medium salt content)>γ=g(low salt content).

This gradient g(c) can for example be used to adapt the target value yend to represent the correct target time tend, i.e. yend=yend(g(c)). For example, the target value yend(α) for the medium salt content can be offset (raised/lowered) to values yend(β) or yend(γ) if the gradient g(c)=β or γ is steeper and less steep, respectively, than the gradient g(c)=α for the medium salt content c. The value of the offset can vary with the difference of the gradient values α, β, γ. The offset can be determined experimentally. Different values for the offset relating to different gradients g(c) can be stored in memory, e.g. in a look-up table. Therefore, for example, the drying cycle is terminated at a time yend(β) if the gradient g(c) of the curve C2 has been determined to be β, which gives the correct target time tend.

Also, the gradient g(c) of a drying cycle can be stored in a memory and later retrieved and/or used for the next drying cycle such that the next drying cycle can use corrected values for controlling it from the beginning.

Furthermore, the gradients g(c) of multiple drying cycles can be stored as an average value to make the correction even more robust. Here, it is assumed that the salt content c at the user's premises is at least quasi-constant. The average value may be an arithmetical average or an exponential average. The exponential average may be preferred to give a greater weight to newer gradient values.

Further, the memory may be erased, e.g. if the clothes drying appliance is to be located at another place that may have tap water of a different salt content.

Of course, the invention is not limited to the embodiment as described above.

For example, the gradient is not limited to a gradient from a linear relationship between values representing the moisture content and the time or a corresponding parameter (linear gradient), e.g. a relationship of the filtered values y over time t or series number m. Alternatively, the gradient may be a gradient from a non-linear relationship (including a curve fit) between values representing the moisture content and the time or a corresponding parameter (non-linear gradient), e.g. an exponential relationship of the (unfiltered) maximum values over time t or series number m. The corresponding gradient may be an exponential gradient or exponential parameter characteristic for this relationship.

The invention claimed is:

1. A clothes drying appliance, comprising:

a controller controlling operation of the clothes drying appliance, an AC voltage generator controlled by the controller and producing an AC voltage signal, a DC filter for removing DC portions from the AC voltage signal, electrodes for applying the DC-filtered AC voltage signal to clothes, a peak detector operative connected to the controller for measuring a peak of a current produced by the DC-filtered AC voltage signal applied to clothes, wherein the clothes drying appliance is configured to determine a salt content of moisture emanating from the drying clothes, measure a current running through the clothes, and determine a moisture content of clothes from the measured current by taking into account the determined salt content of the moisture.

2. The clothes drying appliance according to claim 1, wherein the moisture content of clothes is determined by determining a gradient of a curve formed from pairs of variates representing the moisture content over time, and setting at least one target value of a drying cycle based on the gradient.

3. The clothes drying appliance according to claim 2, wherein the at least one target value is set by correcting the at least one target value for a pre-determined salt content by adding an offset value, wherein the offset value is based upon a difference of the determined gradient and a gradient corresponding to the pre-determined salt content.

4. The clothes drying appliance according to claim 2, wherein the curve is a linear curve.

5. The clothes drying appliance of claim 2, wherein the curve is an exponential curve.

6. The clothes drying appliance according to claim 2, wherein the controller is further configured to store gradients from multiple measurements as an average gradient, and set the at least one target value based on the average gradient.

7. The clothes drying appliance of claim 2, wherein the at least one target value comprises a target value representative of the moisture content at which a target time for terminating the drying cycle is reached.

8. The clothes drying appliance according to claim 1, wherein the controller is further configured to:

measure the DC-filtered AC current signal for consecutive samples, generate from the measured AC current signal for the consecutive samples an envelope signal, generate a series of maximum values from n consecutive samples of the envelope signal, and pass the series of the maximum values through a logarithmic filter to produce series of filtered values, wherein the filtered values or a curve derived from the filtered values represent the moisture content of the clothes over time.

9. The clothes drying appliance according to claim 8, wherein a target value of a drying cycle representative of the moisture content at which a target time for terminating the drying cycle is reached is based on the filtered values.

10. The clothes drying appliance according to claim 8, wherein the envelope signal comprises consecutive peak values extracted from the measured DC-filtered AC current signal over a corresponding sample time.

11. The clothes drying appliance according to claim 8, wherein the filter uses a relation comprising $y(m)=y(m-1)+\log(a, x(m)-y(m-1))$, wherein $y(m)$ is an m-th filtered value, $y(m-1)$ is a previous filtered value, a is a parametric log base and $x(m)$ is an m-th maximum value received from the filter.

* * * * *